US009963850B2

(12) United States Patent
Chattell

(10) Patent No.: US 9,963,850 B2
(45) Date of Patent: May 8, 2018

(54) ACOUSTIC BARRIER AND METHOD OF PILE DRIVING

(71) Applicant: RVT GROUP LIMITED, Dartford (GB)

(72) Inventor: Timothy Chattell, Dartford (GB)

(73) Assignee: RVT GROUP LIMITED, Dartford (GB)

( * ) Notice: Subject to any disclaimer, the term of this patent is extended or adjusted under 35 U.S.C. 154(b) by 0 days. days.

(21) Appl. No.: 15/317,464

(22) PCT Filed: Jun. 12, 2015

(86) PCT No.: PCT/GB2015/051734
§ 371 (c)(1),
(2) Date: Dec. 9, 2016

(87) PCT Pub. No.: WO2015/189635
PCT Pub. Date: Dec. 17, 2015

(65) Prior Publication Data

US 2017/0114514 A1 Apr. 27, 2017

(30) Foreign Application Priority Data

Jun. 12, 2014 (GB) ..... 1410494.7

(51) Int. Cl.
*E02D 13/00* (2006.01)
*G10K 11/162* (2006.01)

(52) U.S. Cl.
CPC ..... *E02D 13/005* (2013.01); *G10K 11/162* (2013.01)

(58) Field of Classification Search
CPC ..... E02D 13/005
See application file for complete search history.

(56) References Cited

U.S. PATENT DOCUMENTS 3,975,918 A * 8/1976 Jansz ..... E02D 13/00 173/DIG. 2
4,124,987 A * 11/1978 Hallman ..... E02D 13/00 173/DIG. 2

(Continued)

FOREIGN PATENT DOCUMENTS

DE 1 634 324 B1 1/1971
DE 1784396 B1 * 7/1971 ..... E02D 13/00

(Continued)

OTHER PUBLICATIONS

English language abstract for DE 1 634 324 B1, Jan. 7, 1972.

(Continued)

*Primary Examiner* — Frederick L Lagman
(74) *Attorney, Agent, or Firm* — Finnegan, Henderson, Farabow, Garrett & Dunner, LLP

(57) ABSTRACT

There is disclosed an acoustic barrier (40) for use in a pile driving method in which a pile (I0) is driven into the ground 60, the acoustic barrier (40) comprising: an acoustic dampening layer (42); and a magnetic element (36); wherein the acoustic barrier (40) is arranged to be at least partly wrapped around an axial portion of the pile (I0) so that the acoustic dampening layer (42) at least partly surrounds the axial portion of the pile (I0), and wherein the magnetic element (36) is arranged to releasably secure the acoustic barrier (40) to the pile (I0). There is also disclosed a pile driving method comprising wrapping the acoustic barrier (40) around an axial portion of a pile (I0), driving an axial length of the pile (I0) into the ground, and removing or repositioning the acoustic barrier (40). There is also disclosed an acoustic barrier for a pile driving hammer having a support frame which can be detachable attached to the hammer.

3 Claims, 5 Drawing Sheets

(56) References Cited

U.S. PATENT DOCUMENTS

Figure 1:
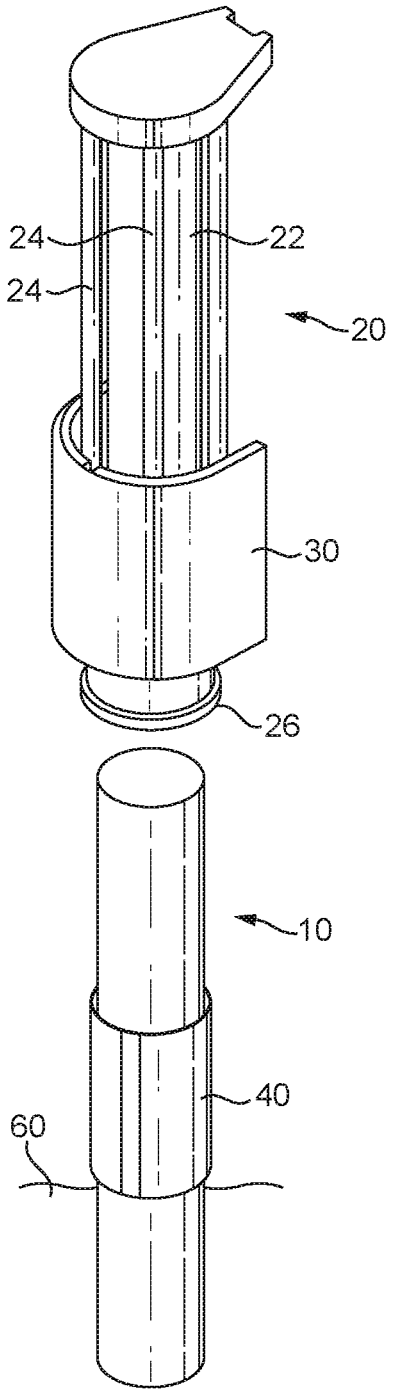

| | | | | |
|---|---|---|---|---|
| 7,476,056 | B2 * | 1/2009 | Dreyer | F16L 55/0336 405/211 |
| 8,794,375 | B2 * | 8/2014 | Jung | E02D 7/14 181/205 |
| 2009/0129871 | A1 * | 5/2009 | Mohr | E02D 13/00 405/232 |
| 2011/0299938 | A1 * | 12/2011 | Jung | E02D 13/00 405/228 |
| 2015/0110564 | A1 * | 4/2015 | West | E02D 3/10 405/227 |

FOREIGN PATENT DOCUMENTS

| | | | | |
|---|---|---|---|---|
| EP | 2402511 | A1 * | 1/2012 | E02D 13/00 |
| JP | 5-30233 | | 4/1993 | |

OTHER PUBLICATIONS

English language abstract for JP 5-30233, Apr. 20, 1993.
International Search Report for PCT/GB2015/051734, dated Jul. 23, 2015.
Written Opinion of the International Searching Authority for International Application No. PCT/GB2015/051734.
English translation of DE 1 634 324 B1.

* cited by examiner

ACOUSTIC BARRIER AND METHOD OF PILE DRIVING

This application is a national stage filing under 35 U.S.C. § 371 of International Application No. PCT/GB2015/051734, filed on Jun. 12, 2015, which claims priority of British Patent Application No. 1410494.7, filed Jun. 12, 2014. The contents of these applications are each incorporated herein by reference.

The invention relates to an acoustic barrier for use in a pile driving operation and a corresponding pile driving method.

Piles are driven into the ground to provide structural supports for structures such as buildings and other civil infrastructure. Piles are typically driven into the ground by hammering the pile in a pile driving operation. Modern hammers for pile driving operations typically comprise a drop weight that is vertically slidable along guide rails, and can be dropped from a height to deliver an impact force to the pile to drive it into the ground.

The hammer impacts the pile above ground-level and is a major cause of noise pollution from construction sites. In particular, hammering a hollow cylindrical steel pile may result in a ringing-type noise from the pile, together with an impact noise from the hammer.

It is known to provide acoustic fencing for a construction site to lessen the impact of construction noise on the local environment. In particular, construction site barriers or fences around construction sites have been improved in recent years to include acoustic material to dampen construction noise. These construction site barriers may be significantly more expensive than conventional construction site barriers or fencing. For large construction sites, these barriers may be several storeys high in order to dampen construction noise from noise sources relatively far from the barrier or from noise sources at a relatively high level above ground, which may otherwise simply travel over the construction barrier.

It is therefore desirable to provide an improved method of controlling noise during a pile driving operation and an improved acoustic barrier for use in a pile driving operation.

According to an aspect of the invention there is provided an acoustic barrier for use in a pile driving method in which a pile is driven into the ground, the acoustic barrier comprising: an acoustic dampening layer; and a magnetic element; wherein the acoustic barrier is arranged to be at least partly wrapped around an axial portion of the pile so that the acoustic dampening layer at least partly surrounds the axial portion of the pile, and wherein the magnetic element is arranged to releasably secure the acoustic barrier to the pile.

The pile may be substantially cylindrical. The pile may be ferromagnetic. The pile may be composed of iron, steel or stainless steel. The acoustic dampening layer may be composed of polyvinyl chloride (PVC), or a high tenacity polyester which may be coated with PVC. The acoustic dampening layer may be flame retardant and/or heat resistant. The acoustic dampening layer may comprise a flame retardant coating or fabric. The acoustic dampening layer may comprise a core, which may comprise a foam material or other suitable acoustic material. The foam material be open cell impregnated polyether. The core may be coated, for example, the core may be coated with a flame retardant and/or heat resistant coating. The acoustic dampening layer may be between 5 mm and 100 mm thick.

The acoustic barrier may be flexible so that it can be curved around at least one axis to conform to the surface of the pile. The acoustic barrier may have a pre-formed curved shape for attaching to the surface of the pile. The acoustic barrier may be resiliently flexible. Alternatively, the acoustic barrier may be stiff or substantially rigid.

The acoustic barrier may comprise a plurality of discrete panels arranged to be coupled together to form the acoustic dampening layer.

There may be a plurality of magnetic elements. The magnetic elements may be spaced apart over the acoustic dampening layer. The magnetic elements may be spaced apart laterally along the curtain. The magnetic elements may be substantially equally laterally spaced apart.

The acoustic barrier may comprise a plurality of substantially elongate arrays of magnetic elements, each array comprising a plurality of magnetic elements.

Each array of magnetic elements may extend substantially axially. In other words, each array of magnetic elements may be parallel with the lateral sides of the acoustic barrier; the axis about which the barrier is flexible and/or the axis of the pile. There may be at least two, at least three, at least four, at least five or more arrays of magnetic elements. Each array of magnetic elements may comprise at least two, at least three, at least four, or at least five or more magnetic elements. The axial arrangement of the arrays of magnetic elements may allow the acoustic barrier to easily conform to the surface of the pile.

The or each magnetic element may be substantially elongate. There may be a plurality of substantially elongate magnetic elements. The magnetic elements may extend substantially axially and may be parallel to one another; the lateral sides of the acoustic barrier; the axis about which the barrier is flexible and/or the axis of the pile.

The acoustic barrier may have two closure portions disposed at opposite lateral ends of the acoustic dampening layer and arranged to attach to each other when the barrier is wrapped around the pile so as to close the barrier around the pile. At least one of the closure portions may comprise a magnetic element for attaching to the other closure portion.

The closure portions may comprise corresponding hook and loop fastening portions (e.g. Velcro®) for attaching to one another. The acoustic barrier may be arranged to wrap fully around an axial portion of the pile so that the acoustic dampening layer fully surrounds the axial portion of the pile.

The acoustic barrier may comprise a closed loop arranged to fit over the pile. The acoustic barrier may have resilient elastic portions so that it can radially expand to fit over the pile and then contract to be secured against the pile by friction. The acoustic barrier may comprise a plurality of acoustic barrier panels attached by elastic portions.

According to a further aspect of the invention there is provided a pile driving method comprising: wrapping an acoustic barrier in accordance with the invention at least partly around an axial portion of a pile so that the acoustic dampening layer at least partly surrounds the axial portion of the pile; driving an axial length of the pile into the ground so that the acoustic barrier moves downwardly with the pile; and removing or repositioning the acoustic barrier.

The acoustic barrier may be wrapped round the pile so that the or each magnetic element is immediately adjacent the pile to magnetically attach thereto. Alternatively, the magnetic element may be embedded within the acoustic barrier so that the magnetic element acts through a portion of the acoustic barrier to magnetically hold the acoustic barrier on the pile.

The acoustic barrier may have two closure portions and wrapping the barrier around the pile may comprise attaching the closure portions to each other to close the barrier around the pile.

The acoustic barrier may be removed or repositioned when it reaches a threshold height above ground level. The acoustic barrier may be removed from or repositioned from an axial portion of the pile when the axial portion of the pile is entirely above ground level.

A plurality of acoustic barriers in accordance with the invention may be wrapped around respective axial portions of the pile so that the respective dampening layers at least partly surround the respective axial portions of the pile.

The method may comprise successively removing the acoustic barriers as they approach ground level.

The method may comprise repositioning the acoustic barrier to a relatively higher axial portion of the pile.

The method may comprise repeatedly driving an axial length of the pile into the ground and repositioning the acoustic barrier to a relatively higher axial portion of the pile, which steps may be repeated until the pile is completely driven into the ground or until a limit maximum axial length of the pile protrudes above ground level. The limit length may correspond to the axial length of the acoustic barrier.

Repositioning the acoustic barrier may comprise sliding the acoustic barrier upwardly along the pile without removing the barrier from the pile. Alternatively, repositioning the acoustic barrier may comprise removing the acoustic barrier and re-wrapping the acoustic barrier around the relatively higher portion of the pile.

Ground level may be the ground level local to the pile. Ground level may be the level of the opening of the bore formed for or by the pile.

According to a further aspect of the invention, there is provided an acoustic barrier for a pile driving hammer, comprising: a support frame which can be detachably attached to the hammer; and an acoustic dampening layer attached to the support frame so that, with the support frame attached to the hammer, the acoustic dampening layer at least partly surrounds an axial portion of the hammer.

The axial portion of the hammer may be a lower portion of the hammer adjacent the end of the hammer that is arranged to contact a pile. The support frame may be arranged to radially space the acoustic dampening layer from the hammer. The support frame and acoustic dampening layer may be arranged so that the acoustic dampening layer fully surrounds an axial portion of the hammer. Alternatively, the support frame and acoustic dampening layer may be arranged so that the acoustic dampening layer extends only partially circumferentially around the hammer.

The support frame and/or the acoustic dampening layer may comprise a plurality of discrete parts.

There is also provided a hammer for use in a pile driving operation and an acoustic barrier according to the invention attached to the hammer.

There is also provided a method of retro-fitting a hammer for use in a pile driving operation with an acoustic barrier according to the invention, the method comprising attaching the support frame to the hammer. The support frame may be attached to the hammer using pre-existing attachment portions on the hammer, such as pre-existing bolt holes.

According to a broad aspect of the invention there is provided a method of pile driving comprising: coupling an acoustic barrier comprising an acoustic dampening layer around an axial portion of a pile; and driving the pile at least partially into the ground so that the acoustic barrier moves downwardly with the pile.

The method may further comprise removing or repositioning the pile as described herein. The acoustic barrier may be coupled to the axial portion of the pile by magnetic elements. The acoustic barrier may be coupled to the axial portion of the pile by closing the barrier around the pile so that it is held on the axial portion of the pile by friction.

The acoustic barrier may comprise closure portions disposed at opposite lateral ends of the acoustic dampening layer and arranged to attach to each other to close the barrier around the pile, and coupling the acoustic barrier to the axial portion of the pile may comprise closing the barrier around the pile so that the barrier is held on the axial portion of the pile by friction. The closure portions may be magnetic. The closure portions may comprise hook and loop fasteners.

The acoustic dampening layer may be flexible, resiliently flexible, or alternatively may be stiff and/or substantially rigid.

Figure 2:
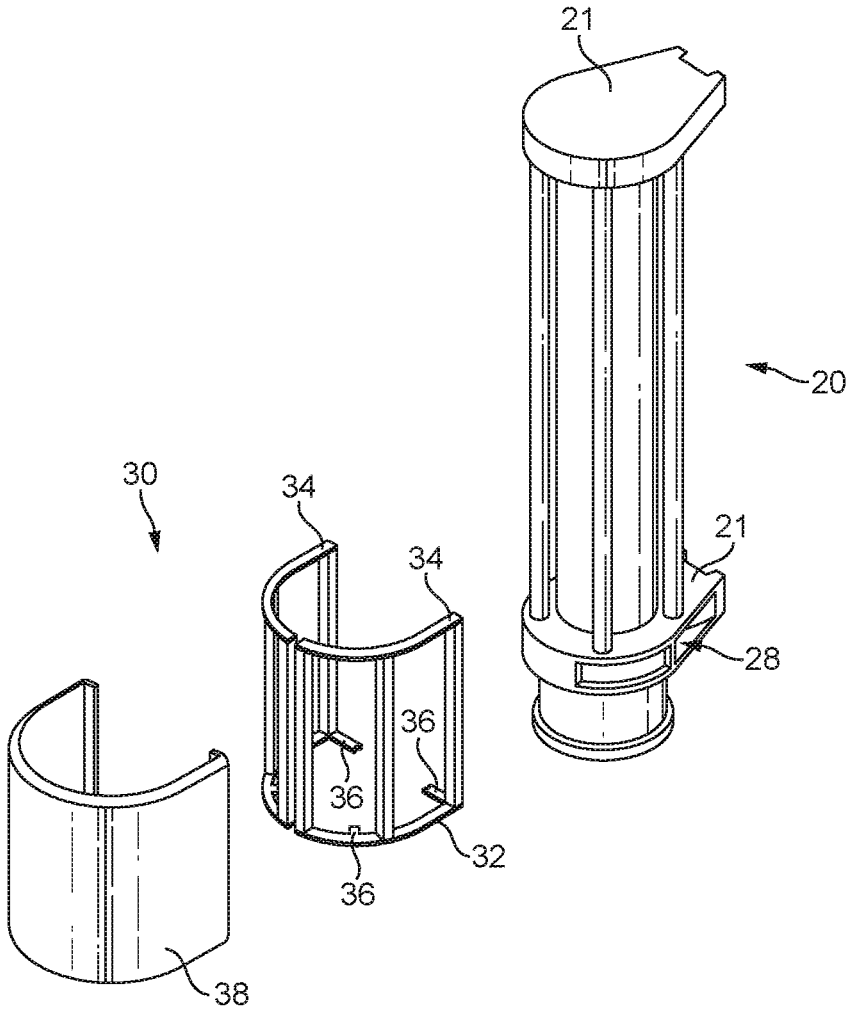
Figure 3:
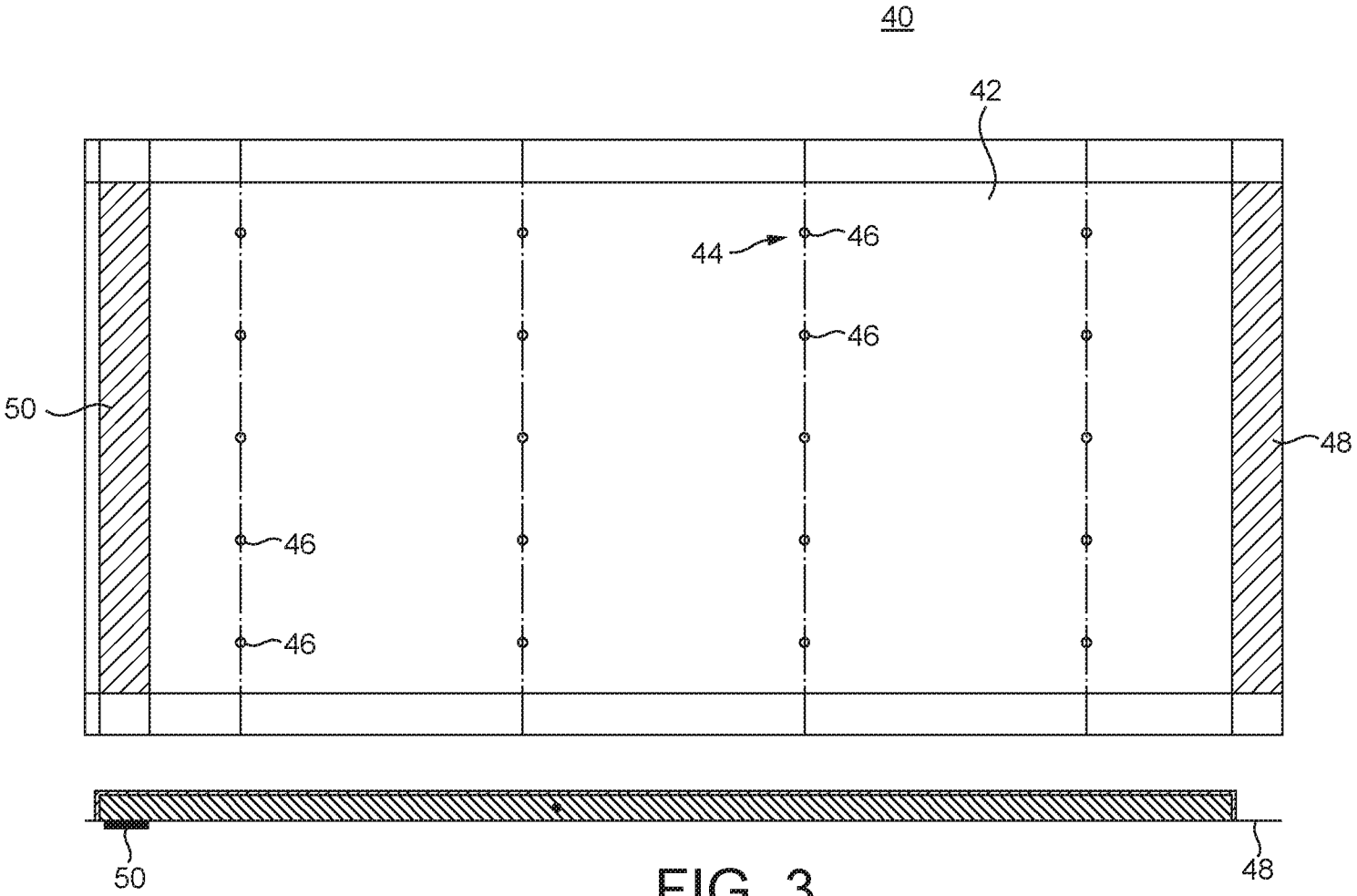
Figure 6:
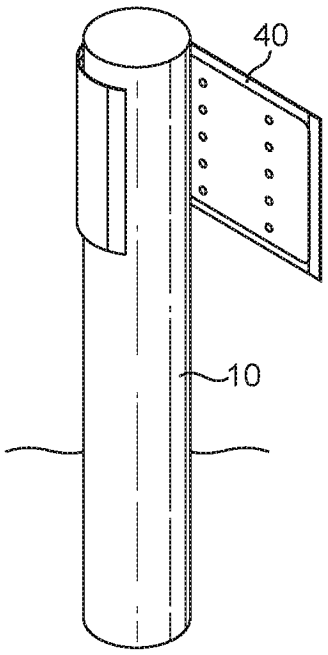
Figure 5:
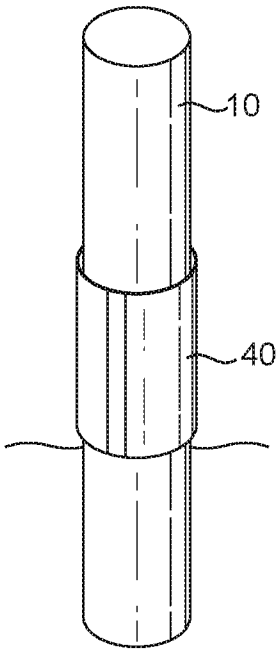
Figure 4:
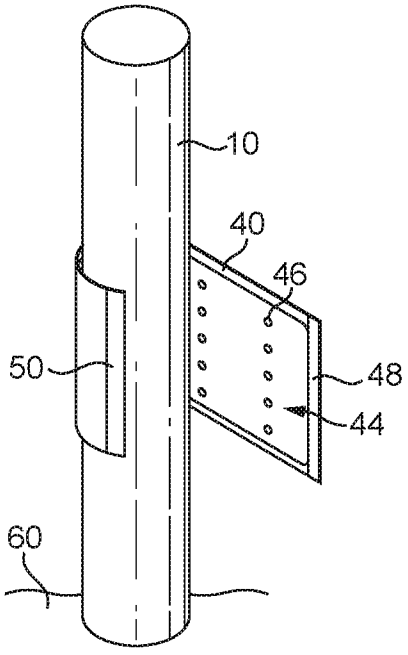

The invention will now be described, by way of example, with reference to the following drawings in which:

FIG. 1 schematically shows a hammer and pile in a pile driving operation;

FIG. 2 schematically shows the hammer of FIG. 1 in exploded view;

FIG. 3 schematically shows the acoustic barrier for the pile of FIG. 1 in plan and side views;

FIG. 4 schematically shows the pile with the acoustic barrier partially wrapped around the pile according to an embodiment of the invention;

FIG. 5 schematically shows the pile of FIG. 4 after a pile driving operation;

FIG. 6 schematically shows the pile of FIG. 4 with the acoustic barrier repositioned on the pile.

Figure 7:
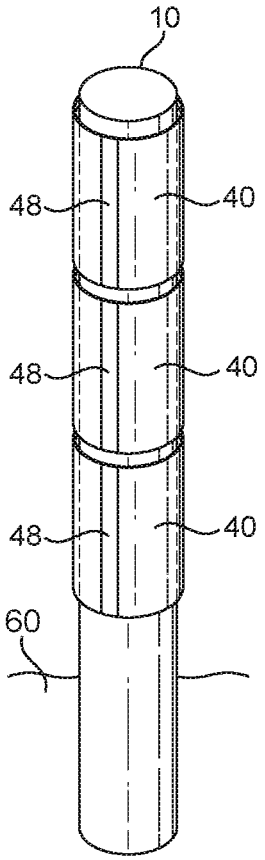
Figure 8:
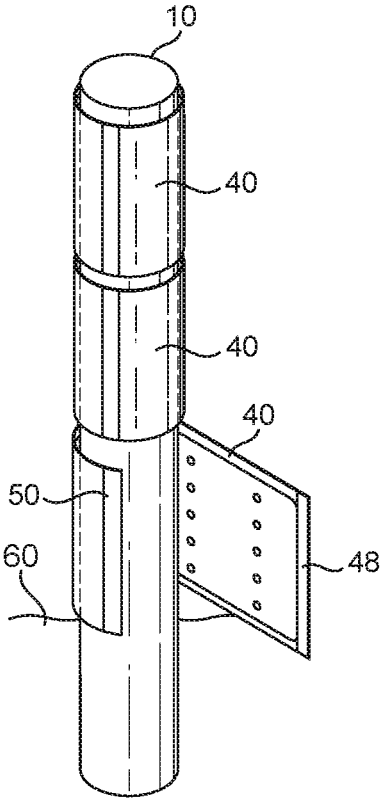

FIG. 7 schematically shows the pile provided with a plurality of acoustic barriers;

FIG. 8 schematically shows the pile of FIG. 7 after a pile driving operation.

FIG. 1 shows a pile 10 and a hammer 20 for driving the pile 10 into the ground 60. The pile 10 comprises a hollow steel tube of approximately 600 mm in diameter and 6 m in length with a wall thickness of approximately 10 mm.

The hammer 20 is arranged to be held by a crane above the pile 10 by crane attachment portions 21 (FIG. 2). The hammer 20 comprises a hammer body 22, a set of vertical guide rails 24 for guiding a drop load (not shown) along the hammer body 22, and a hammer head 26 at the lower end of the hammer body 22. In use, the hammer 20 is held above the pile so that the hammer head 26 rests on the top of the pile 10, and the drop load is successively raised and dropped in a pile driving operation to drive the pile 10 into the ground.

Pile driving operations typically generate high levels of noise. In order to reduce the level of noise, acoustic barriers are provided according to the invention for both the hammer 20 and the pile 10. An acoustic barrier 30 is provided for the lower end of the hammer 20, and a further acoustic barrier 40 is provided for the pile 10.

As shown in FIG. 2, the acoustic barrier 30 comprises a support frame 32 having a curved profile that, viewed from above, has a semi-circular forward portion, straight sides and an open rear. The support frame 32 comprises two discrete supports 34, each forming one side and one half of the semi-circular front of the support 32. Each support 34 has attachment portions 36 for attaching to the hammer body 22 by bolt holes 28 formed in the hammer body 22. In this embodiment, the support frame 32 is configured to be retro-fitted to the hammer 20 making use of existing bolt holes 28 in the hammer body 22. The support frame 32 can be fitted to the hammer body 22 by installing each support 34 from the front and/or side of the hammer body 22.

The acoustic barrier 30 for the hammer 20 further comprises an acoustic dampening layer 38 or acoustic curtain arranged to fit over the frame. In this embodiment, the acoustic dampening layer 38 comprises high tenacity polyester, although any suitable acoustic material may be used. The acoustic dampening layer 38 is flexible so that it conforms to the shape of the support frame 32 when attached thereto. The acoustic dampening layer 38 is attached to the support frame 32 by clips (not shown), but in other embodiments may be bolted to the frame 32 or coupled to the frame by any another suitable means.

In other embodiments, the acoustic dampening layer 38 may be pre-formed so that it has a curved shape corresponding to that of the support frame 32 before it is installed.

FIG. 3 shows the acoustic barrier 40 for the pile 10 unfurled from the pile 10 (i.e. before attachment to the pile). The acoustic barrier 40 comprises a layer of acoustic dampening material 42 approximately 2 m wide and 50 mm thick. The acoustic dampening layer 42 is sized to wrap around the pile 10 so that its lateral ends meet or face one another, taking into account the thickness of the acoustic dampening layer 42.

The acoustic barrier 40 further comprises a plurality of arrays 44 of magnetic elements 46 spaced apart over one side of the acoustic dampening layer 42. In this embodiment, there are four arrays 44 laterally spaced apart on a first surface of the acoustic dampening layer 42. Each array 44 extends in an axial direction perpendicular to the lateral direction of the barrier 40, so that they are substantially parallel with the axis of the pile 10 when the barrier 40 is wrapped around the pile 10.

Each array 44 comprises a plurality of magnetic elements 46 axially spaced apart and attached to the acoustic dampening layer 42. In this embodiment, there are five magnetic elements 46 in each array 44. Each magnetic element is approximately 25 mm in diameter and 5 mm thick, and has a lifting weight of approximately 7 kgs (i.e. each magnetic element is capable of lifting a ferromagnetic weight of 7 kgs, in particular a steel weight). The magnetic elements 46 can be attached to the acoustic dampening layer 42 by any suitable means, such as by an adhesive, by bolts or other fastening elements.

The acoustic barrier 40 further comprises two hook and loop (e.g. Velcro®) closure portions 48, 50, one at each lateral end of the acoustic dampening layer 42. Both closure portions 48, 50 are disposed on the opposite side of the acoustic dampening layer 42 from the magnetic elements 46, so that in use with the acoustic barrier 40 wrapped around the pile 10, the closure portions 48, 50 are disposed on the radially outer surface of the acoustic dampening layer 42 whilst the magnetic elements 46 are disposed on the radially inner surface.

A first closure portion 48 is attached to the acoustic dampening layer 42 at a first lateral end (the right end in FIG. 3) so as to extend laterally beyond the acoustic dampening layer 42. A second closure portion 50 is attached to the acoustic dampening layer 42 at a second opposing lateral end (the left end in FIG. 3) so that in use, as the acoustic barrier 40 is wrapped around the pile, the first closure portion 48 overlaps the second closure portion 50 to close the acoustic barrier 40 around the pile.

Two example pile driving methods in which the noise is controlled using the acoustic barriers 30, 40 will now be described.

According to a first example pile driving method shown in FIGS. 4 to 6, a pile 10 is partially inserted into a bore drilled into the ground 60 in preparation for driving the pile 10 into the ground 60. The acoustic barrier 30 for the hammer 20 is assembled onto the hammer 20 by installing the support frame 32 on the hammer 20 by bolts, and by attaching the acoustic dampening layer 38 to the support frame 32 by clips, as described above.

The acoustic barrier 40 for the pile 10 is wrapped around an axial portion of the pile 10 elevated from ground level so that it is magnetically held on the pile 10 by the magnetic elements 46 of the arrays 44 (FIG. 4). The hook and loop closure portions 48, 50 are attached to each other to secure the lateral ends of the acoustic barrier 40 in place.

The hammer 20 is then operated to drive an axial length of the pile 10 into the ground 60 in a pile driving operation. The acoustic barrier 40 remains held on the axial portion of the pile 10 and moves downwardly with the pile 10 towards the ground (FIG. 5).

The acoustic barrier 40 is then repositioned to a relatively higher axial portion of the pile 10 before it reaches ground level. In this example method, a threshold of 1 m above ground level is set, and the pile driving operation is temporarily stopped when the acoustic barrier 40 is closer than 1 m to the ground so that it can be repositioned.

In this example method, the acoustic barrier 40 is repositioned by removing it (unwrapping it) from the axial portion of the pile 10 to which it is attached, and re-wrapping it around a relatively higher portion of the pile 10.

In other pile driving methods, a plurality of acoustic barriers 40 may be wrapped around the pile 10, and the lowermost acoustic barrier 40 may be removed and repositioned to an unoccupied space on the pile 01 when it reaches a threshold distance above ground level. Accordingly, a pile driver operator can make maximum use of the number of acoustic barriers available to them. For example, two acoustic barriers may be available and may initially be wrapped around axially separated portions of the pile 10. When one of the acoustic barriers approaches ground level it may be repositioned to a relatively higher axial portion of the pile 10, which may be above or below the other of the acoustic barriers.

A second example method of pile driving is shown in FIGS. 7 and 8. This second example method differs from the first method in that the pile 10 is initially prepared by wrapping a plurality of acoustic barriers 40 around adjacent axial portions of the pile so that they are disposed substantially axially end-to-end on the pile 10. This method may provide for maximum acoustic dampening from the pile 10 as the protruding part of the pile is surrounded by acoustic dampening material. As before, the lowest acoustic barrier 40 is initially wrapped around an axial portion of the pile 10 that is elevated above ground level.

The hammer 20 is then operated to drive an axial length of the pile 10 into the ground 60 in a pile driving operation. The acoustic barriers 40 remain held on the respective axial portions of the pile 10 and move downwardly with the pile 10 towards the ground (FIG. 5).

The lowermost acoustic barrier 40 is then removed from the pile 10 before it reaches ground level. In this example method, a threshold of 1 m above ground level is set, and the pile driving operation is temporarily stopped when the acoustic barrier 40 is closer than 1 m to the ground so that it can be removed.

In an alternative pile driving method, there may be a single acoustic barrier 40 that is wrapped around an upper axial portion of the pile (e.g. a portion adjacent the top of the pile 10), which may be removed as it approaches ground level or passes a threshold distance above ground level.

In use, the acoustic barrier 30 attached to the hammer 20 dampens the noise from the drop weight of the hammer 20 and the impact on the pile, and the or each acoustic barrier

40 wrapped around the pile 10 dampens the noise from the pile 10. In particular, it is known that piles, such as hollow steel piles, may ring or reverberate during a pile driving operation. The or each acoustic barrier 40 acts to dampen the ringing or reverberating sound of the pile 10 during pile driving, thereby reducing the environmental impact of pile driving on the immediate surroundings.

The acoustic barrier 30 for the hammer 20 and the acoustic barrier 40 for the pile 10 can be used to dampen noise substantially at the source of noise generation. Accordingly, the acoustic barriers of the invention may therefore be more effective in controlling noise from a pile driving operation than acoustic barriers installed around the perimeter of a construction site. Further, use of acoustic barriers according to the invention may mean that expensive acoustic barriers for the perimeter of a construction site may not be required in order to control noise from a pile driving operation.

The invention claimed is:

1. A method for pile driving comprising:

providing an acoustic barrier comprising an acoustic dampening layer and a magnetic element, wherein the magnetic element is arranged to releasably secure the acoustic barrier to a pile;

wrapping said acoustic barrier at least partly around an axial portion of the pile so that the acoustic dampening layer at least partly surrounds the axial portion of the pile;

driving an axial length of the pile into the ground so that the acoustic barrier moves downwardly with the pile; and removing or repositioning the acoustic barrier;

wherein the acoustic barrier is removed or repositioned when it reaches a threshold height above ground level; and wherein the method comprises repositioning the acoustic barrier to a relatively higher axial portion of the pile.

2. The method for pile driving according to claim 1, wherein the method comprises repeatedly driving an axial length of the pile into the ground and repositioning the acoustic barrier to a relatively higher axial portion of the pile.

3. The method for pile driving according to claim 1, wherein repositioning the acoustic barrier comprises sliding the acoustic barrier upwardly along the pile without removing the barrier from the pile.

* * * * *